United States Patent [19]

Lawrence

[11] 4,381,711

[45] May 3, 1983

[54] HAND-HELD SHOT TUBE DETONATOR

[75] Inventor: Howard Lawrence, Sunbury, Pa.

[73] Assignee: E.I.T. Corporation, Sunbury, Pa.

[21] Appl. No.: 196,922

[22] Filed: Oct. 14, 1980

[51] Int. Cl.[3] ..... F42B 3/10

[52] U.S. Cl. ..... 102/275.11; 102/200

[58] Field of Search ..... 102/204, 200, 275.6, 102/275.11, 275.12

[56] References Cited

U.S. PATENT DOCUMENTS

| | | | |
|---|---|---|---|
| 414,662 | 11/1889 | Tirmann | 102/204 |
| 997,800 | 7/1911 | Fuller | 102/275.11 |
| 3,296,968 | 1/1967 | Shulman et al. | 102/204 |
| 3,590,739 | 7/1971 | Persson | 102/275.5 |
| 3,706,277 | 12/1972 | Willard et al. | 102/275.4 |
| 3,762,267 | 10/1973 | Travor et al. | 102/275.11 |
| 3,792,660 | 2/1974 | Plumer | 102/275.5 |
| 4,037,537 | 7/1977 | Thorsell et al. | 102/200 |

FOREIGN PATENT DOCUMENTS

| | | | |
|---|---|---|---|
| 2424504 | 11/1975 | Fed. Rep. of Germany | 102/200 |
| 2522881 | 12/1976 | Fed. Rep. of Germany . | |
| 2525718 | 12/1976 | Fed. Rep. of Germany | 102/200 |
| 2920135 | 11/1980 | Fed. Rep. of Germany | 102/275.6 |
| 1640 | of 1892 | United Kingdom . | |

*Primary Examiner*—Charles T. Jordan

*Attorney, Agent, or Firm*—Thomas Hooker

[57] ABSTRACT

A hand-held shot tube detonator including a primer and shot tube holder removably mounted on a firing pin body having a flash guard movable between extended and retracted positions. The flash guard is retracted to permit mounting of the holder on the body and is then extended to surround the holder to channel the flash and explosive gases away from the operator when the detonator is fired.

33 Claims, 7 Drawing Figures

18
10
56
68
112
90
94
88
92
84
86
100
108
110
34
46
40
38
42
36
78
6
5

58
70
72
76
74
7

HAND-HELD SHOT TUBE DETONATOR

The invention relates to devices of the type used to fire an explosive shot shell primer for igniting a shot tube or igniter cord extending to an explosive charge. Conventional hand-held detonators are shown in Fuller U.S. Pat. No. 997,800 and British Pat. No. 1,640 of 1892. In these detonators, a spring-driven pin fires an explosive primer which in turn ignites an igniter cord. In the Fuller patent, the primer is spaced from the cord.

Detonators of this kind are fired by explosive shot shell primers, conventionally of the type used to fire shotgun shells. These primers are similar in shape to the shape of small caliber center-fire bullet casings. Because of the similarity between the primers and bullets, it is important that the detonator have a single purpose and not be readily convertible to fire bullets.

In the detonator of the invention, the primer and shot tube or igniter cord are both held in a single, removable holder separate from the firing pin body. This holder includes a thin-wall and cross-bored primer recess and a diametrically smaller thin-walled hollow neck axially aligned with the recess with the interior of the neck communicating with the recess. The tube or cord is held in the free end of the neck and is ignited by the shock wave and pyrotechnic blast of the exploding primer in the recess.

It is impossible to use an unmodified detonator as a handgun because a bullet would not fit within the holder primer recess and the bullet would not pass through the small interior opening in the neck. The holder cannot be readily modified to receive a bullet since drilling out to provide additional space for the bullet would materially weaken the holder and would break off the neck. The thin-walled and cross-bored primer recess would be so weakened as to almost assure the holder would be blown apart upon the discharge of a bullet. Further, the firing pin end of the body engaging the back of the cap is domed to provide sufficient support for a primer but insufficient for the base of a fired bullet. These single-purpose features of the invention limit its use to its intended purpose of igniting shot tube or igniter cord and mean there is no need to meet the many governmental requirements concerning manufacture, transport, sale and use of handguns.

The detonator includes a flash guard sleeve on the firing pin body which is extended to surround the holder prior to firing. The holder neck extends outwardly of the sleeve a short distance and carries a circumferential deflecting collar. Upon firing of the primer, the sleeve controls the expanding flash and combustion gases and guides them axially downstream away from the operator. The collar is in the path of the gases and in part deflects them radially outwardly for a rapid dispersion.

The flash guard is secured to the firing pin body by a groove and slot connection so that when the guard is retracted, it is impossible for the primer to be fired accidentally. Rotation of the flash guard from the retracted position prior to extension to surround the holder biases the firing pin handle in a direction away from the firing position to reduce the chance of accidentally dislodging the firing pin to fire the primer. The slot is located between the cross bores in the primer holder to prevent direct venting of the flash and combustion gas through the slot.

Other objects and features of the invention will become apparent as the description proceeds, especially when taken in conjunction with the accompanying drawings illustrating the invention, of which there are two sheets.

IN THE DRAWINGS

DESCRIPTION OF THE DETONATOR

Figure 5:
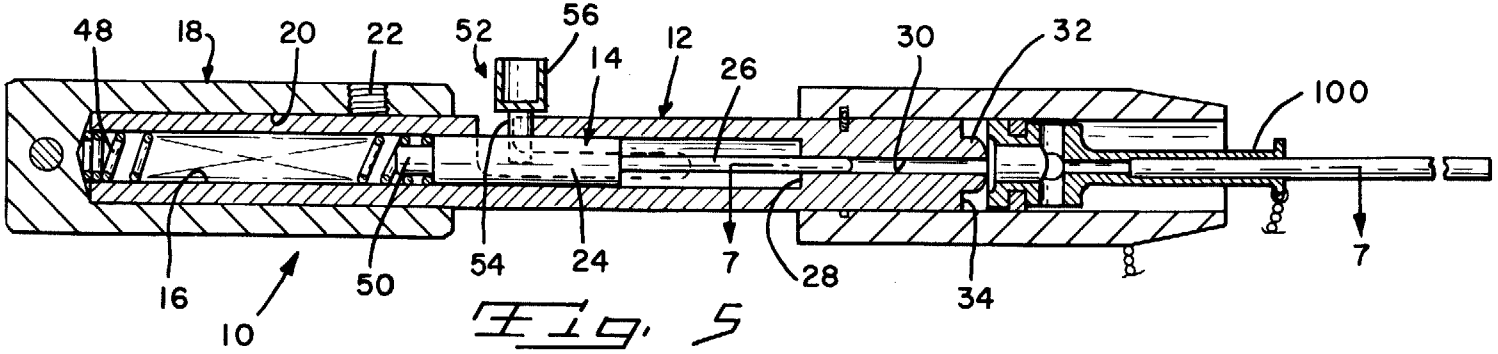
FIG. 5 is the sectional view taken along line 5—5 of FIG. 3.

Hand-held detonator 10 includes a cylindrical firing pin body 12 with firing pin 14 fitting within bore 16 extending into the body from the lefthand thereof as viewed in FIG. 5 and cylindrical handle 18 having bore 20 fitted over the bore end of the body and held in place on the body by means of a suitable set screw 22.

The firing pin 14 includes a cylindrical portion 24 having a sliding fit within bore 16. A reduced diameter pin 26 extends axially from body 24 past the bottom 28 of bore 16, into axial pin bore 30 and through the center of domed, axially symmetrical primer seat 32 on end surface 34. Body extension 36 includes an arm 38 projecting axially from surface 34 and a pair of spaced fingers 40 extending up from opposite edges of the arm 38 toward the opposite side of the body. The fingers define a central U-shaped opening 42. See FIG. 1. The arm 38 has an outer surface defined by an extension of the outer surface of the cylindrical body 12 and a flat chordal surface 44 forming the bottom of a slot 46 between surface 34 and the inner surfaces of the fingers 40. The domed seat 32 extends into slot 46.

Firing pin spring 48 is confined within bore 16 between the firing pin body 24 and the end of the bore at handle 18. The spring extends over reduced diameter pilot 50 on the firing pin to hold the spring in place during operation of the detonator. Firing pin handle or trigger 52 includes a shank 54 extending into a cross bore in firing pin body 24 and an enlarged knob or grip 56 located outwardly of the body. Shank 54 is secured to the firing pin by a riveting operation using a tool extending to the firing pin through body bore 58. See FIGS. 3 and 4. The knob 56 is preferably metal with a hollow center to reduce the inertial mass of handle 52.

The firing pin handle extends outwardly of the body 12 through a generally J-shaped slot 60 having a long axial run 62 and a short circumferential run 64 of about 90° with a locking recess 66 remote from run 62 on the side of circumferential run 64 away from handle 18. Run 64 is at the upstream end of run 62. The side 67 of run 64 extending from the locking recess 66 to run 62 is angled rearwardly toward the handle 18. When the firing pin is in the cocked position of FIGS. 3 and 5, spring 48 biases shank 54 into the locking recess.

Cylindrical flash guard 68 is slidably mounted on the end of body 12 away from handle 18. The flash guard includes a J-shaped slot 70 having a long axial run 72, and approximately 45° circumferential run 74 on the downstream end of run 72 and extending around the detonator in the same direction run 64 extends around the detonator from the end of run 62. A locking recess 76 is provided on the upstream side of the run 76 at the end of the run away from run 72. A guide pin 78 on body 12 extends into slot 70 to limit movement of the flash guard with respect to the body. Spring ball 80 is carried in body 12 and engages interior circumferential groove 82 of flash guard 68 to hold the flash guard in its extended or downstream position shown in FIGS. 3, 4 and 7 with pin 78 at the upstream end of groove run 72.

Primer and shot tube holder 84 includes a cylindrical body 86 having a pair of cross bores 88 extending through the body at right angles. Circular flange 90 with flat 92 is spaced from body 84 by groove 94 having a width slightly greater than the thickness of fingers 40. A large diameter primer bore or recess 96 extends axially from flange 90 to the cross bores for receiving a detonating primer. The diameter of the flange 90 is slightly greater than the diameter of body 86. Flat 92 is essentially tangent to the bottom of the groove 94.

The holder 84 includes thin-walled neck 100 extending axially from the end of body 86 away from flange 90. A small diameter axial bore 102 extends from the cross bores 88 through the body 86 and into neck 100. This bore joins slightly larger shot tube bore 104 at step 106 in the neck. The bore 104 extends from the step to the end of the neck away from body 86. A circumferential flash deflecting collar 108 extends around the free end of neck 100.

The holder 84 is secured to the flash guard 68 by chain 110 having ends secured to the collar 108 and to the flash guard. Preferably, the exterior surfaces of the handle 18 and of flash guard 68 are knurled to facilitate holding the detonator and manipulating the flash guard with respect to the handle and body.

OPERATION OF DETONATOR

The detonator 10 is used to ignite a firing element leading to an explosive charge, and is particularly useful in igniting a hollow plastic shot tube having an explosive coating on its interior surface. A shot tube of this type is disclosed in Persson U.S. Pat. No. 3,590,739. The detonator may also be used to ignite conventional igniter cord. Both shot tube and igniter cord are ignited by exploding a primer adjacent the upstream end of the tube or cord so that the expanding shock wave and pyrotechnic blast contact and ignite the tube or cord. The detonator may be used to ignite other types of non-destructive firing elements and is not limited to use with shot tubes or igniter cords. The drawings illustrate use of the detonator with a shot tube.

Figures 1, 2, 3, 4:
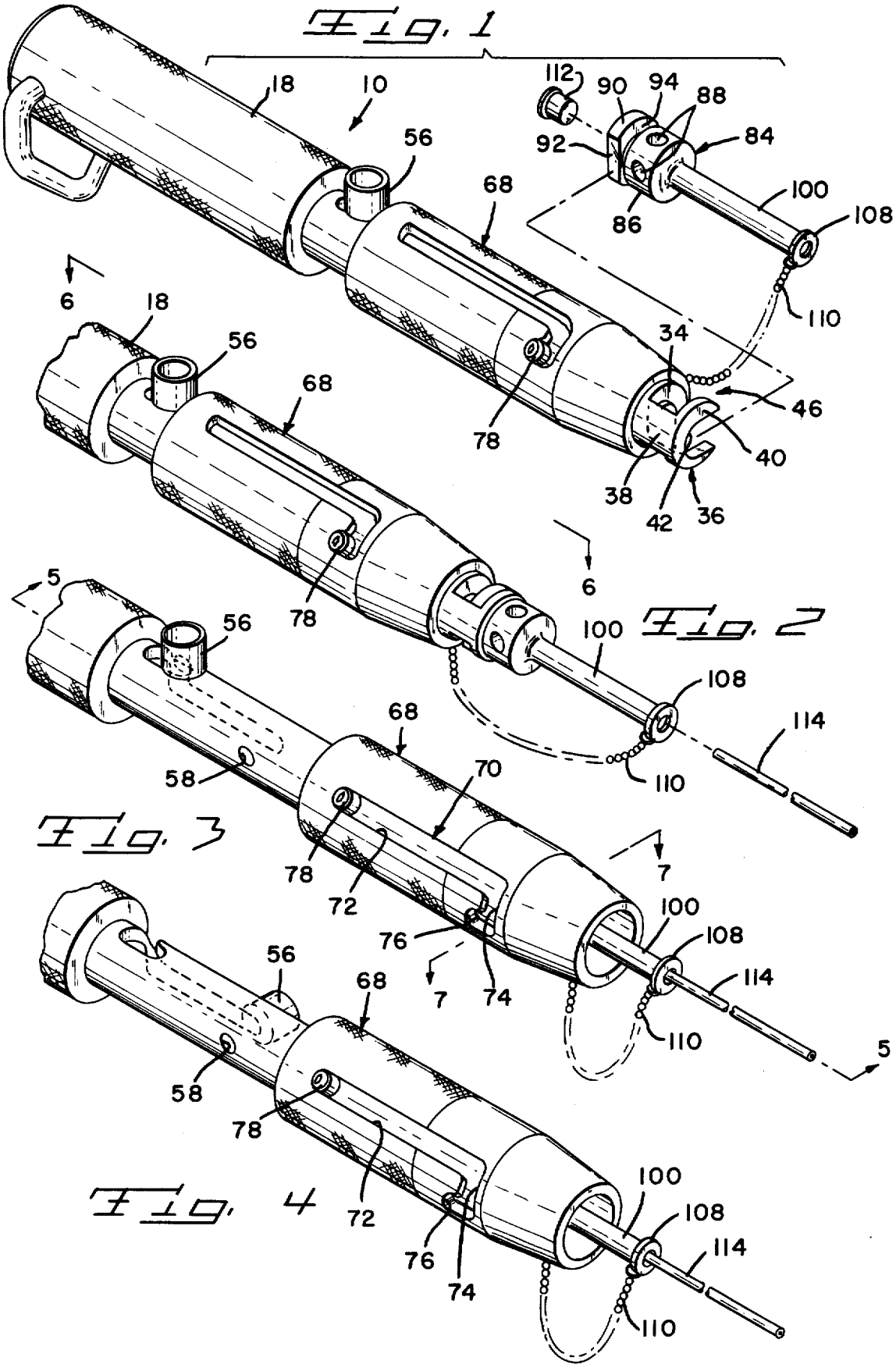
FIG. 1 is a perspective view of a detonator according to the invention with the flash guard retracted.
FIG. 2 is a partial view of FIG. 1 showing the primer and shot tube holder mounted on the detonator body.
FIG. 3 is similar to FIG. 2 but with a flash guard rotated and extended.
FIG. 4 is similar to FIG. 3 with the firing pin extended.
Figure 6:
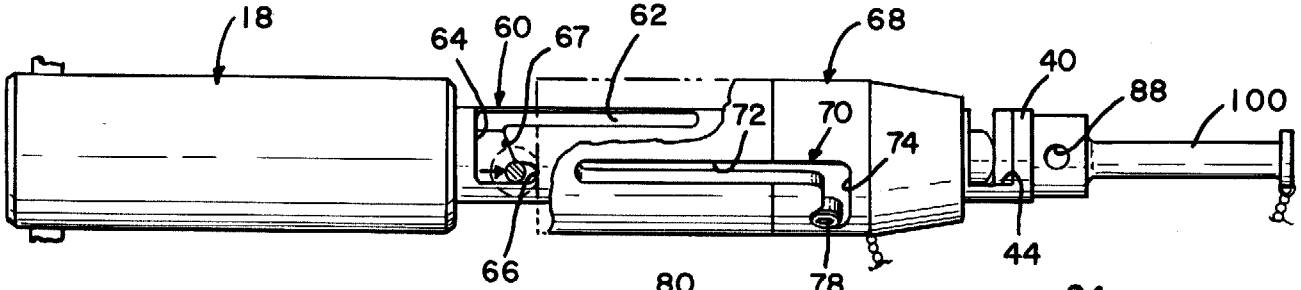
FIG. 6 is a side view of FIG. 2 taken along line 6—6.

FIG. 4 illustrates the position of the detonator after firing. In order to prepare the detonator for a subsequent firing, the operator removes the spent tube from holder 84. He then holds handles 18 and 52 and retracts the firing pin from the extended position by moving shank 54 upstream along slot run 62 and then across slot run 64 so that when the handle is released, spring 48 biases the shank into locking recess 66. In this position, the end of the firing pin 14 is withdrawn from primer seat 32 as shown in FIG. 5. The flash guard is then retracted from the position of FIG. 4 toward handle 18 by moving pin 78 along slot run 72 and then along circumferential slot run 74. As pin 78 approaches run 74, the upstream guard end 112′ picks up firing pin handle 56 to further compress spring 48 so that the flash guard is biased on the downstream direction and lock recess 76 is positively seated on the pin 78 as illustrated in FIGS. 1 and 6. In this position, the shank is firmly held in place in the recess 66.

Figure 7:
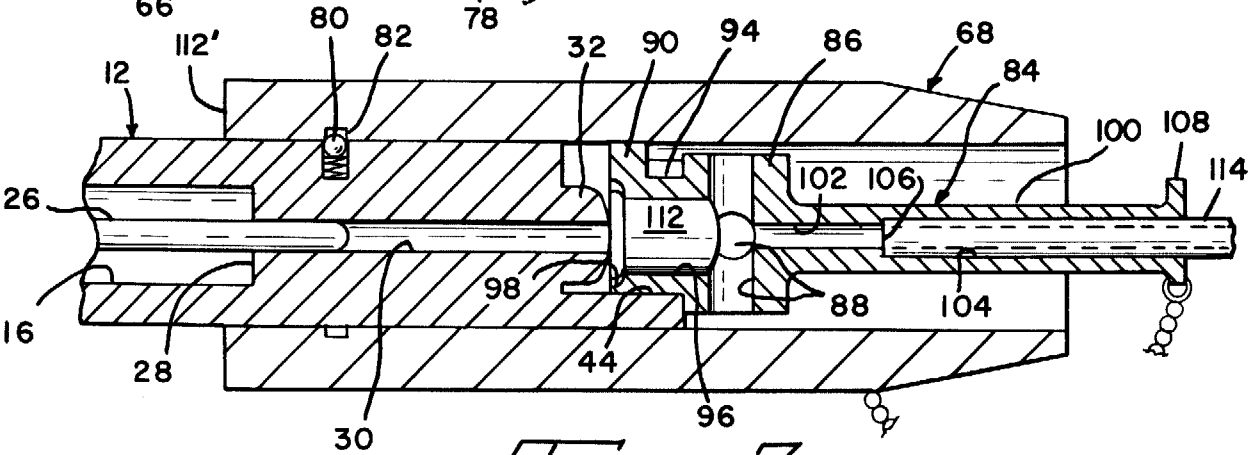
FIG. 7 is a sectional view taken along line 7—7 of FIG. 5.

With the detonator in this position, the operator removes holder 84 from the body, unloads the spent primer and loads a new primer 112 into bore 96 of the holder. The primer may be a conventional type used to fire shotgun shells. The loaded holder 84 is then fitted on the downstream end of detonator 10 with fingers 40 extending into the groove 94 and flange flat 92 flush on the chordal inner surface of arm 38. Flange 90 has a thickness equal approximately to the distance between the end of the seat 32 and arms 40 so that, as illustrated in FIG. 7, the end of the seat is flush with the firing end of primer 112. The fit of the holder in slot 42 assures the primer is axially aligned with firing pin 14. The diameter of body 86 is less than the interior diameter of the flash guard so that the outer ends of the cross bores 88 are spaced from the flash guard.

With the loaded holder 84 mounted on the detonator, the operator holds the handle 18 and flash guard 68 and moves the flash guard upstream toward the handle sufficiently to unseat pin 78 from recess 76, rotates the flash guard to bring pin into slot run 72 and then extends the flash guard in a downstream direction to seat the pin 78 at the upstream end of run 72. In this position the spring ball 80 extends into groove 82 to hold the flash guard against accidental dislodgement. Upstream movement of the flash guard to enable the pin 78 to clear recess 76 slightly compresses the firing pin spring 48 but does not move the firing pin sufficiently upstream to free the shank from locking recess 66. Rotation of the flash guard to move the pin 78 across slot run 74 from recess 76 to the major slot run 72 biases the firing pin handle circumferentially away from the slot run 62 to assure that the frictional engagement between the rotating flash guard and firing pin handle do not bias the handle toward the portion 62 of slot 60 to decrease the chance of accidentally firing the detonator.

With the flash guard 68 fully extended as in FIG. 3, the shot tube 114 is inserted into neck bore 104 until it engages stop 106. Tube 114 extends from the detonator 10 to an explosive charge. Firing of the detonator ignites the shot tube and fires the charge. The tube is ignited by moving the firing pin handle from the position of FIG. 3 to the slot run 62 and then releasing the handle. This operation is performed by moving the handle both upstream and circumferentially around the body 12 to the slot run 62. In this way accidental firing of the primer is reduced.

The spring 48 biases the firing pin downstream so the tip of pin 26 projects from the end of the domed seat 32 into primer 112 to fire the primer. The firing pin bottoms on bore end 28. The firing pin handle knob 56 is counterbored in order to lighten the handle and prevent inertial bending of the handle when the firing pin bottoms. The shock wave and pyrotechnic blast from primer 112 expand across bores 88 and through bore 102 to the interior of tube 112 to ignite the coating on the interior of the tube and fire the explosive.

The blast from firing of primer 112 is vented through cross bores 88 into the interior of flash guard and thence downstream along the flash guard in an axial direction. The deflecting collar 108 on the free end of neck 100 deflects the blast radially outwardly so that it is quickly and effectively dispersed in a direction away from the operator. When the flash guard is extended, run 72 of slot 70 extends past the body of cap holder 84 midway between the ends of the adjacent cross bores 88. Location of the slot between the ends of the cross bores prevents direct discharge of the explosive blast through the slot.

The outside diameter of neck 100 is slightly smaller than the inside diameter of the cap bore 96 so that drilling out of the cap bore to allow reception of a bullet would severely weaken or break off the neck from holder 84. The body 86 would also be severely weakened.

While I have illustrated and described the preferred embodiments of my invention, it is understood that these are capable of modification, and I therefore do not wish to be limited to the precise details set forth, but desire to avail myself of such changes and alterations as fall within the purview of the following claims.

What I claim my invention is:

1. A detonator of the type including a firing pin body with a firing pin, a spring biasing the firing pin toward a firing position, and a trigger operable to release the firing pin for movement to the firing position, wherein the improvement comprises a holder separate from the body having a cap bore for receiving an explosive primer, at least one vent passage in the holder intersecting the cap bore, a hollow neck extending away from the cap bore adapted to surround the upstream end of a shot tube or the like, the interior of the neck communicating with the primer bore; and means for removably mounting the holder on the firing pin body with the bore at the firing position, said means including abutting surfaces on said body and holder preventing movement of the holder away from the firing position when the primer is fired whereby the shock wave and blast expand from the primer bore into and along the interior of the neck to ignite the shot tube and are vented through the passage.

2. A detonator as in claim 1 wherein the firing pin is movable along a longitudinal axis and the primer bore and neck are aligned on said axis when the holder is mounted on the firing pin body.

3. A detonator as in claim 2 wherein the neck includes an interior step facing the free end thereof for limiting insertion of the shot tube.

4. A detonator as in claim 2 wherein the firing pin body includes a domed primer seat and said firing pin extends through the top of the dome to fire the primer.

5. A detonator as in claim 2 wherein the firing pin body includes an elongate portion surrounding the firing pin and including an elongate hollow flash guard mounted on the portion and movable along the portion between a retracted position permitting mounting of the holder on the firing pin body and an extended position where the flash guard surrounds the vent passage.

6. A detonator as in claim 5 wherein said means includes an extension on the body having finger means spaced downstream from the end of the body, and the holder includes a flange movable between the finger means and the body.

7. A detonator as in claim 5 wherein said flash guard includes an inner surface mounted on the body and longitudinally movable and radially rotatable on said body, a pin and slot connection between the guard and body including a pin extending outwardly from said body and a slot in the guard, the pin extending into the slot, said slot having an elongate axial run and a short radial run at the downstream end of the axial run, a pin locking recess on the upstream side of the radial run away from the long run for receiving said pin and holding the flash guard in the retracted position, and means for holding the guard in the extended position.

8. A detonator as in claim 7 wherein the firing pin body includes an axial bore, said firing pin being fitted within said bore, a spring fitted between the upstream end of the firing pin and the upstream end of the bore to bias the firing pin downstream, a slot extending through the body having a long axial run, a short radial run at the upstream end of the axial run and a locking recess on the downstream side of the radial run away from the axial run, said firing pin including a trigger extending outwardly through said slot and having a sliding fit therewith whereby the firing pin is cocked by moving the trigger upstream along the long run and radially along the short run so that the spring holds the trigger in the recess, the axial distance between the upstream end of the flash guard and the locking recess therein being slightly greater than the axial distance between the pin on the body and the downstream edge of the trigger when the trigger is seated in the recess on the firing pin body whereby movement of the flash guard to the retracted position and seating of the pin on the firing pin body in the recess of the flash guard lifts the trigger a slight distance from the seated position so that the spring biases the flash guard against the pin.

9. A detonator as in claim 8 wherein the trigger locking recess has sufficient axial length to prevent radial movement of the pin when the flash guard is in the locked upstream position.

10. A detonator as in claim 8 wherein the downstream side of the firing pin body radial run is angled upstream from the recess to the axial run so that the trigger must be moved both radially and axially upstream in order to fire the detonator.

11. A detonator as in claim 8 wherein in each slot the short run extends radially from the long run in the same circumferential direction around the detonator.

12. A detonator as in claim 8 wherein the trigger includes an enlarged hollow handle outside the body slot.

13. A detonator as in claim 5 including an outwardly extending radial collar on the neck.

14. A detonator as in claim 7 wherein said means includes surfaces on the firing pin body and holder angularly orienting the holder with respect to the body and wherein the axial run of the flash guard slot does not overlie the vent passage when the flash guard is extended.

15. A detonator of the type having a body, a primer bore, a firing pin, a spring biasing the firing pin toward the bore to detonate an explosive primer in the bore, a trigger for releasing the firing pin to detonate the primer and a vent passage communicating with the bore, wherein the improvement comprises a hollow thin-walled neck extending away from the end of the bore remote from the trigger, said neck being adapted to receive the upstream end of the slot tube or the like whereby the shock wave and pyrotechnic blast from the firing of a primer travel through the neck to ignite the tube and are vented through the vent passage.

16. A detonator as in claim 15 wherein said bore and neck are axially aligned with the outside diameter of the neck being not appreciably greater than the inside diameter of the bore so that the neck cannot be bored out to form an extension of the bore for receiving a bullet.

17. A detonator as in claim 16 including means for venting combustion gases downstream along the outside of the neck and wherein the neck includes an outwardly extending deflecting flange.

18. A detonator as in claim 15 including a flash guard surrounding the body and movable between a retracted position remote from the bore and an extended position surrounding the bore and vent passage so that the flash guard prevents immediate radial expansion of the explosive gases.

19. A detonator as in claim 18 including a plurality of cross bores intersecting the bore, the cross bores opening to the extended flash guard.

20. A detonator as in claim 18 wherein the neck extends axially beyond the end of the extended flash guard and includes a flash deflecting collar.

21. A detonator as in claim 15 wherein the neck includes means for limiting insertion of a tube toward the bore.

22. A detonator including a body having a primer receiving cavity, a vent passage communicating with said cavity with the exterior of the body, a firing passage communicating with said primer cavity and including an end away from the primer cavity adapted to receive the upstream end of a shot tube or the like, and firing pin means for igniting a primer in the cavity so that the flash travels through said firing passage to ignite the shot tube and is vented through the vent passage.

23. A detonator as in claim 22 wherein said primer cavity and firing passage are coaxial and the vent passage extends laterally from the primer cavity.

24. A detonator as in claim 22 including a flash deflector spaced from and overlying the outer end of the vent passage.

25. A detonator as in claim 24 wherein the vent passage includes a cross bore extending through the primer cavity and the flash deflector surrounds the body and overlies the cross bore.

26. A detonator as in claim 22 including mounting means removably securing the body and firing pin means together, the primer cavity opening at the junction between the body and the firing pin means, a flash guard and a connection securing the flash guard to the firing pin means permitting movement of the flash guard between a first position overlying the vent passage and a second position remote from the body.

27. A detonator as in claim 26 wherein the firing passage extends axially beyond the end of the flash guard when in the first position and includes a flash deflecting collar on the end thereof away from the primer cavity.

28. A detonator as in claim 26 wherein said mounting means includes means preventing relative axial or rotational movement between the body and the firing pin means.

29. A detonator as in claim 22 wherein the body surrounding the primer cavity includes a weak thin-walled section.

30. A detonator as in claim 23 wherein the body includes a thin-walled neck extending away from the primer cavity, said firing passage extending through said neck, the exterior diameter of the neck being not appreciably greater than the interior diameter of the primer cavity so that the firing passage cannot be bored out to form an extension of the cavity to receive a bullet.

31. A detonator as in claim 22 wherein the firing passage includes means for limiting insertion of a shot tube or the like into the passage.

32. A detonator as in claim 22 wherein the firing passage includes a step facing away from the primer cavity limiting insertion of a shot tube or the like into the passage.

33. A detonator as in claim 26 wherein the firing pin means includes a domed cap seat adjacent the primer cavity when the body and firing pin means are mounted together.

* * * * *